US009534880B2

(12) United States Patent
McPherson et al.

(10) Patent No.: US 9,534,880 B2
(45) Date of Patent: Jan. 3, 2017

(54) LIQUID ELECTRICALLY INITIATED AND CONTROLLED GAS GENERATOR COMPOSITION

(71) Applicant: Digital Solid State Propulsion LLC, Reno, CA (US)

(72) Inventors: Michael D. McPherson, Reno, NV (US); Tim Manship, Reno, NV (US)

(73) Assignee: Digital Solid State Propulsion, LLC, Reno, NV (US)

( * ) Notice: Subject to any disclaimer, the term of this patent is extended or adjusted under 35 U.S.C. 154(b) by 0 days.

(21) Appl. No.: 15/144,701

(22) Filed: May 2, 2016

(65) Prior Publication Data

US 2016/0245633 A1 Aug. 25, 2016

Related U.S. Application Data

(62) Division of application No. 14/732,695, filed on Jun. 6, 2015, now Pat. No. 9,328,034, which is a division of (Continued)

(51) Int. Cl.

| | |
|---|---|
| ***C06B 47/00*** | (2006.01) |
| ***D03D 23/00*** | (2006.01) |
| ***D03D 43/00*** | (2006.01) |
| ***F42D 1/045*** | (2006.01) |
| ***C06B 31/00*** | (2006.01) |
| ***C06B 31/28*** | (2006.01) |

(Continued)

(52) U.S. Cl.

CPC ..... *F42D 1/045* (2013.01); *C06B 23/005* (2013.01); *C06B 23/006* (2013.01); *C06B 23/007* (2013.01); *C06B 25/34* (2013.01); *C06B 31/00* (2013.01); *C06B 31/28* (2013.01); *C06B 47/00* (2013.01)

(58) Field of Classification Search

USPC ..... 149/45, 1, 108.6, 109.6

See application file for complete search history.

(56) References Cited

U.S. PATENT DOCUMENTS 3,698,969 A * 10/1972 Fein et al. ..... C06B 47/08 149/19.1

5,223,057 A * 6/1993 Mueller ..... C06B 47/00 149/45

(Continued)

*Primary Examiner* — James McDonough

(74) *Attorney, Agent, or Firm* — Mathew J. Temmerman; Temmerman Law Office

(57) ABSTRACT

A liquid electrically initiated and controlled composition comprising an oxidizer, soluble fuel additive(s), and other optional additives to enhance the chemical or ballistic properties, or a combination thereof is disclosed. The liquid composition further comprises stabilizers to enhance thermal stability, sequestrants to minimize deleterious effects of transition metal contaminants, and combustion enhancers maximizing efficiency. Buffers and heavy metal sequestering or complexing agents may be used in combination to achieve the highest degree of thermal stability. Additional ionic co-oxidizers may be added to the liquid composition to stabilize the liquid oxidizer and further depress freezing point. The liquid phase of matter allows flow via pipes or tubes from tanks, reservoirs, or other containers, through metering valves, followed by ignition or combustion modulation when stimulated by electrodes, statically or dynamically.

13 Claims, 6 Drawing Sheets

| *Formulation Ingredient* | *Purpose* | *Range, wt%* |
|---|---|---|
| Hydroxylammonium Nitrate | Oxidant | 65–79 |
| 2,2'–Bipyridyl | Sequestrant and Stabilizer | 0.1–1.0 |
| Ammonium Dihydrogen Phosphate | Buffer and Stabilizer | 0.1–1.0 |
| Water | Process Aid | 1–3 |
| Fuel Additive (note 1.) | Fuel | 15–30 |
| n–octanol | Process Aid | 0.1–0.5 |
| 5–aminotetrazole | Sequestrant and Stabilizer | 1–3 |
| 1,2,4–triazole | Sequestrant and Stabilizer | 1–3 |
| Co–oxidizer (note 2.) | Oxidant | 2–7 |

Note 1.
Preferred additives are soluble CHO compounds such as cyclodextrins, other complex saccharides, hydroxyl–substituted cellulosics such as hydroxyethyl–, hydroxypropyl cellulose as examples Note 2.
Preferred co–oxidizer is ammonium nitrate, organo–substituted amine nitrates such as methyl ammonium nitrate and various homologs, soluble in the hydroxylammonium nitrate liquid oxidizer matrix, as examples

Related U.S. Application Data application No. 14/040,442, filed on Sep. 27, 2013, now Pat. No. 9,182,207.

(60) Provisional application No. 61/718,132, filed on Oct. 24, 2012.

(51) Int. Cl.
*C06B 23/00* (2006.01)
*C06B 25/34* (2006.01)

(56) References Cited

U.S. PATENT DOCUMENTS

| | | | | |
|---|---|---|---|---|
| 2008/0178975 | A1 | 7/2008 | Hori | |
| 2011/0067789 | A1* | 3/2011 | Grix | C06B 23/001 149/19.1 |
| 2012/0103479 | A1* | 5/2012 | Katzakian | C06B 45/10 149/19.1 |

* cited by examiner

| *Formulation Ingredient* | *Purpose* | *Range, wt%* |
|---|---|---|
| Hydroxylammonium Nitrate | Oxidant | 65--79 |
| 2,2'--Bipyridyl | Sequestrant and Stabilizer | 0.1--1.0 |
| Ammonium Dihydrogen Phosphate | Buffer and Stabilizer | 0.1--1.0 |
| Water | Process Aid | 1--3 |
| Fuel Additive (note 1.) | Fuel | 15--30 |
| n--octanol | Process Aid | 0.1--0.5 |
| 5--aminotetrazole | Sequestrant and Stabilizer | 1--3 |
| 1,2,4--triazole | Sequestrant and Stabilizer | 1--3 |
| Co--oxidizer (note 2.) | Oxidant | 2--7 |

Note 1.
Preferred additives are soluble CHO compounds such as cyclodextrins, other complex saccharides, hydroxyl--substituted cellulosics such as hydroxyethyl--, hydroxypropyl cellulose as examples Note 2.
Preferred co--oxidizer is ammonium nitrate, organo--substituted amine nitrates such as methyl ammonium nitrate and various homologs, soluble in the hydroxylammonium nitrate liquid oxidizer matrix, as examples

FIG. 1

Properties of the main cyclodextrins

| Cyclodextrin | Mass | Outer diameter, (nm) | Cavity diameter (nm) | | Cavity volume, (mL/g) | Solubility g/kg $H_2O$ | Hydrate $H_2O$ | |
|---|---|---|---|---|---|---|---|---|
| | | | Inner rim | Outer rim | | | cavity | external |
| α, $(glucose)_6$ | 972 | 1.52 | 0.45 | 0.53 | 0.10 | 129.5 | 2.0 | 4.4 |
| β, $(glucose)_7$ | 1134 | 1.66 | 0.60 | 0.65 | 0.14 | 18.4 | 6.0 | 3.6 |
| γ, $(glucose)_8$ | 1296 | 1.77 | 0.75 | 0.85 | 0.20 | 249.2 | 8.8 | 5.4 |

FIG. 2D

LIQUID ELECTRICALLY INITIATED AND CONTROLLED GAS GENERATOR COMPOSITION

RELATED APPLICATIONS

This application is a continuation application of nonprovisional utility patent application Ser. No. 14/732,695, filed Jun. 6, 2015, which was a continuation application of nonprovisional utility patent application Ser. No. 14/040,442, filed Sep. 27, 2013 and granted as U.S. Pat. No. 9,182,207 on Nov. 10, 2015, and which claims priority from the U.S. provisional application Ser. No. 61/718,132, which was filed on Oct. 24, 2012. The disclosures of those provisional application and nonprovisional applications are incorporated herein as if set out in full.

BACKGROUND OF THE DISCLOSURE

Technical Field of the Disclosure

The present embodiment is related in general to propellants, and in particular to a variety of improvements to previously disclosed electrically controlled solid propellants, wherein said propellants are in a liquid state.

Description of the Related Art

Gas generating compositions are herein defined as any material, which stores chemical energy in a fixed volume. Explosives, propellants, pyrotechnics and other gas generating compositions are examples of materials, which may vary significantly in their performance. Reaction in these compositions generally results from either shock or heat. Explosives and propellants may also be thought of simply as a means of storing gas as a solid. Pyrotechnics typically release much of their energy as heat. Energetic gas generating materials often consist of fuels and oxidizers, which are intimately mixed. Incorporating fuels and oxidizers within one molecule or through chemical and physical mixtures of separate fuel and oxidizer ingredients is generally sufficient to mix the composition. The material may also contain other constituents such as binders, plasticizers, stabilizers, pigments, etc.

Gas-generating propellant compositions have numerous applications such as rocket propulsion systems, fire suppression systems, oil field services, gas field services, mining, torpedoes, safety airbag systems, and other uses where quickly expanding gas is employed for its work output. Often in these applications, it is desirable to control the ignition, burn rate, and extinguishment of a propellant by the application of an electrical current.

One of the major technical drawbacks to solid propellants has always been the lack of throttle control and the ability to restart motors once ignited. Conventional solid propellants also continue to be dangerous to manufacture, transport, and use since they are subject to accidental ignition from flames or sparks. Once ignited, conventional solid propellants lend themselves to be only minimally controlled, are not easily extinguished or restarted. These characteristics limit the function and increase the cost of propellant systems. Typically, such conventional propellants have Department of Transportation (DOT) shipping hazard classifications of Class 1.1 to 1.3 Explosives. In many of these instances, an electrically controlled propellant may allow the duration and burn rate of the propellant to be precisely controlled, while additionally allow cost reductions, mission flexibility, all with reduced hazard classifications simplifying supply or transport.

In some military, space and commercial applications, a smokeless or otherwise low signature propellant is desired. Such formulations typically do not contain metal fuels or chlorine based oxidizers such as ammonium perchlorate. Conventional formulations utilize oxidizers referred to as nitramines in the place of ammonium perchlorate. In other applications, high burn rate composites are required, in which case nitramines (RDX, HMX) in combination with nitroglycerin or nitrocellulose are used. These types of propellants are generally considered class 1.1 Explosives, which require added safety precautions in production, shipping and storage. In addition, high specific impulse ($I_{sp}$) propellants are usually formed with ammonium perchlorate composites containing aluminum. These types of composites generate smoke from both the aluminum combustion and the hydrochloric acid generated when the composition interacts with moisture. Finally, all of the current propellants are spark-sensitive, meaning accidents occurring from stray static charges may at any time cause ignition of the propellants during manufacturing.

In the past, polytetrafluoroethylene (PTFE) and other substances have been used as electrically controlled propellants, but these prior art propellants suffer from two significant drawbacks. First, they often do not extinguish as quickly as desired after the electrical current has stopped. Second, these propellants provide none of their own energy, since all the energy for propellant gas generation comes from the electrical energy source. Further, compositions made from fluorocarbons and active metal fuels generally require the use of a flammable solvent in manufacturing, which can result in spontaneous ignition and disastrous results. Once blending has been achieved, the flammable solvent must be removed and recovered, adding to the cost of the manufacturing process.

In contrast to conventional liquid propellants, conventional solid propellants combusted with electric power traditionally require high voltage (in the range of kilovolts) pulse discharges, resulting in ablation of the propellant surface to produce ionizing gas species that are then accelerated by an electromagnetic field. Propellants such as these suffer from two serious drawbacks. First, conventional solid propellants will not extinguish immediately after the cessation of electrical current, thereby reducing the precision of control. Second, non-energetic solid propellants provide none of their own thrust, since the major portion of the thrust is generated by acceleration of the gas generation ions formed from the electrical energy source. In certain instances, it would be beneficial to directly generate thrust from the gas generated by the chemical combustion of the propellant. To date, neither a liquid, solid or gas phase propellant exists that can provide a dual purpose propulsion system, providing chemical thrust for more rapid movement and hazard avoidance combined with the potential for low thrust, high specific impulse applications.

One of the existing electrically controlled propellants comprises a binder, an oxidizer, and a cross-linking agent. The boric acid (the cross-linking agent as physical properties improvement additive) has been found to physically and chemically interact with the high molecular binder used to make the propellant, thereby improving the ability of the composition to withstand combustion without melting. The propellant also may include 5-aminotetrazole (5-ATZ) as a stability-enhancing additive. The binder of the propellant may include polyvinyl alcohol (PVA) and/or the co-polymer of polyvinyl alcohol/polyvinyl amine nitrate (PVA/PVAN). However, sustained combustion at pressures less than 200 psi without the application of continuous electrical power input is not generally achievable using the propellant. Further, burn rates at pressures above 200 psi (at which the propellants would sustain combustion) are lower than conventional composite solid propellants.

Another existing electrically controlled propellant comprises an ionomer oxidizer polymer binder, an oxidizer mix including at least one oxidizer salt and at least one eutectic material, and a mobile phase comprising at least one ionic liquid. The PVAN polymer in the propellant may be of medium (>100,000) to high molecular weight (<1,000,000). The propellant also may include the controlled cross-linking of the polymer through the use of epoxy resins, the use of a moisture barrier coating, and the addition of combustion additives such as Chromium III and polyethylene glycol polymer. However, under certain circumstances the propellant can melt or soften during combustion, thereby decreasing its effectiveness. More particularly, melting can undermine the ability of the propellant to be used in situations where the propellant must be ignited and extinguished multiple times. In addition, the fluid phase of the propellants in this application has sufficient volatility to slowly evaporate from the surface of the propellant, making its application unsuitable for use in the vacuum of space.

Another existing composition is capable of producing either solid propellant grains, liquid or gel monopropellants, all of which are electrically ignitable and capable of sustained controllable combustion at ambient pressure. Applications for the compositions include among other applications use in small micro-thrusters, large core-burning solid propellant grains, shaped explosives charges for military application, and pumpable liquid and gel monopropellants or explosives for military, commercial mining, or gas and oil recovery. In alternative embodiments, the above compositions may also incorporate an nitrate polymer, burn rate modifiers, and/or metal fuel(s). The High Power Electric Propulsion (HiPEP) formulation makes it possible to ignite and sustain combustion at ambient and vacuum conditions without continuous electrical power while providing faster burn rates.

Various other pyrotechnic compositions exist that include metastable intermolecular composites (MICs), providing liquid oxidizers in place of traditional solvents, thus eliminating the need for solvent extraction. The liquid oxidizer serves as a medium in which to suspend and grow the 3D nanostructure formed by the cross linked polymer (PVA). As a consequence, the 3D nanostructure entraps the liquid oxidizer, preventing it from evaporating and thereby eliminating the need for solvent extraction; and preserves the 3D nanostructure shape. Further, the liquid oxidizer matrix produced provides a mechanism through which ignition and combustion may be controlled. The material combustion rate may be adjusted/throttled through adjustments in the amount of the electrical power supply and may even be extinguished by complete removal of the electrical power supply. Repeated on/off ignition/extinguishment is possible through repeated application and removal of electrical current.

While the propellants disclosed above provide many advantages such as the ability to electrically control both ignition and extinguishing of the propellant, as well as multiple controlled initiation and extinguishing cycles, these electrically controlled propellants (ECPs) may still be improved upon. Specifically, the ECPs previously disclosed can be improved through the selective formulation modifications resulting in the propellants taking on a liquid form.

Based on the foregoing there is a demonstrable need for a liquid composition, which may be electrically initiated and controlled. Such a needed composition would have the ability to electrically control both ignition and extinguishing of the propellant, as well as provide multiple controlled initiation and extinguishing cycles. The liquid composition would comprise additives that act as viscosity modifiers for selective adjustment of the viscosity and flow characteristics (rheology). The additives would provide enhanced chemical, ballistic, rheological and conductive properties as well as greater stability for storage or use at elevated temperatures. Further, the additives would sequester transition metal contaminants that may destabilize the liquid composition, resulting in undesirable off-gassing or premature decomposition, and increase hazard characteristics such as sensitivity to impact or friction. Moreover, the additives provide a pathway to introduce non-polar compounds to the generally polar liquid composition, which impart desired burning rates, ignitability improvement, flame spreading, gas output, and other benefits, which otherwise would not be available due to immiscible behavior. Electrical ignition, combustion adjustment via power controls, modulation of gas generating quantities via flow control techniques of the liquid, all these capabilities exist to advance the science of propulsive performance singly and in combination, which do so without combustion catalysts or pyrotechnic igniters separately employed to assist in the ignition or steady-state combustion of liquid propellants. Finally, the liquid composition would allow the addition of nano-engineered fuel additives (particulate modifiers) to achieve very high burning rates and other aspects of energy management for use in gas generators or propellants. The present embodiment overcomes prior art shortcomings by accomplishing these critical objectives.

SUMMARY OF THE DISCLOSURE

To minimize the limitations found in the prior art and to minimize other limitations that will be apparent upon the reading of the specifications, the preferred embodiment of the present invention provides a liquid electrically initiated and controlled compositions whether propellants, explosives, gas generators, or pyrotechnics.

The present invention discloses an electrically conductive, gas-producing, liquid propellant composition that can be ignited and controlled by applying electrical power of optimum voltage and current. That is, passing electrical current at optimized voltages (typically from 200 to 600V, 10 to 100 milliamps) through the propellant causes ignition/combustion to occur, thereby obviating the need for pyrotechnic ignition of the propellant, or use of combustion aids such as catalysts to generate the required hot gases or sustained combustion. The present invention discloses a variety of improvements that enhance the chemical or ballistic properties, or a combination thereof, of a class of electrically controlled liquid forms. The liquid composition provides electrical control of both ignition and extinguishing of the propellant, as well as provides multiple controlled initiation and extinguishing cycles.

The present invention describes a class of liquid compositions (whether propellants, explosives, gas generators, or pyrotechnics) that improves upon previously disclosed electrically ignited or controlled solid compositions (ECPs). The propellants disclosed herein may be used to stimulate subsurface oil or gas well production and as a replacement of conventional explosives for mining purposes, while maintaining utility of the previously disclosed applications in electrically controlled propellants for chemical propulsion.

Other improvements afforded by compositions in the liquid phase of matter include controllable flow via pipes or tubes from tanks, reservoirs, or other containers, through metering valves, followed by ignition or combustion modulation when stimulated by electrified contacts (electrodes). Electrodes may be powered when the liquid composition is static and in contact, or in flow-through motion while in contact with metering orifices that also function as electrode surfaces. Additionally, flow streams of electrified, conductive, propellants can be initiated when directed to impact oppositely-charged features of design in chambers, rocket engines, or gas-generating combustion devices whether contained to direct gas output, or not. Flowing propellant streams of one single composition, when allowed to take on opposite electrical charges through separate channels, may also be directed to impinge on one another allowing ignition and combustion of burning droplets, similar to the operation of hypergolic bipropellant rocket engines. These characteristics allow energy management of hot gas output for propulsive effects, pressurization, or other benefits of gas-phase output products especially when combined with the other aspects of these electrically-controlled liquid compositions, specifically flow control using valves or metering devices or power control via electrodes in contact with the propellant, statically or dynamically.

In accordance with an aspect of the present invention, the liquid electrically initiated and controlled composition typically comprises an oxidizer, soluble fuel additive(s), and other optional additives to enhance the chemical or ballistic properties, or a combination thereof. In this context chemical optimization is meant to allow optimum combustion via electrodes by modification of ingredients and additives to maximize utility of the invention. According to one embodiment of the present invention, the oxidizer is hydroxylammonium nitrate or hydroxylamine nitrate (HAN). Preferred fuel additives include soluble CHO compounds such as cyclodextrins, other complex saccharides such as xylitol as one example, and hydroxyl-substituted cellulosics such as but not limited to hydroxyethyl and hydroxypropyl cellulose. The optional additives may include stabilizers to enhance thermal stability, sequestrants to remove transition metal contaminants, and combustion enhancers. Buffers and heavy metal sequestering or complexing agents may be used in combination to achieve the highest degree of thermal stability. Additional co-oxidizers may be added to the liquid composition to stabilize the liquid oxidizer and further depress the freezing point. Preferred co-oxidizers include ammonium nitrate, organo-substituted amine nitrates such as methyl ammonium nitrate, and various homologs, soluble in the HAN liquid oxidizer matrix. Further additives may be included in the formulations in accordance with known technology.

A first objective of the present invention is to provide a variety of additives that enhance the properties of electrically controlled propellants as liquid compositions.

A second objective of the present invention is to provide a liquid composition that is capable of flowing via pipes or tubes from tanks, reservoirs, or other containers, through metering valves, followed by ignition or combustion modulation when stimulated by electrodes, while static or in flow-through motion.

A third objective of the present invention is to provide selective adjustment of the viscosity and flow characteristics affecting streams when sprayed through injectors into chambers for combustion, or in atomization of charged liquid propellant droplets, of the liquid composition.

Another objective of the present invention is to provide increased onset temperatures of exothermic propellant reaction rendering formulations of decreased hazards to inadvertent ignition from heat.

A further objective of the present invention is to provide the ability to sequester or retain transition metal contaminants, which inadvertently shorten storage life of electrical formulations.

A further objective of the present invention is to provide a pathway to introduce non-polar compounds to the generally polar liquid compositions via inclusion complexes in complex saccharides such as cyclodextrins.

A final objective of the present invention is to provide high burning rates without the addition of destabilizing metallic or metalloid additives.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

FIG. 1 shows an example of a liquid composition that has proven effective for oil and gas well fracking, when demonstrated in small scale glass capillaries simulating 70 micron or smaller subsurface passages, and provides a baseline composition for related applications in chemical propulsion, pyrotechnics, commercial explosives, when purposely formulated for specific applications in these areas;

FIG. 2D shows a table of properties of the three main types of cyclodextrins (cyclic saccharides)

DETAILED DESCRIPTION OF THE DRAWINGS

Figure 2A:
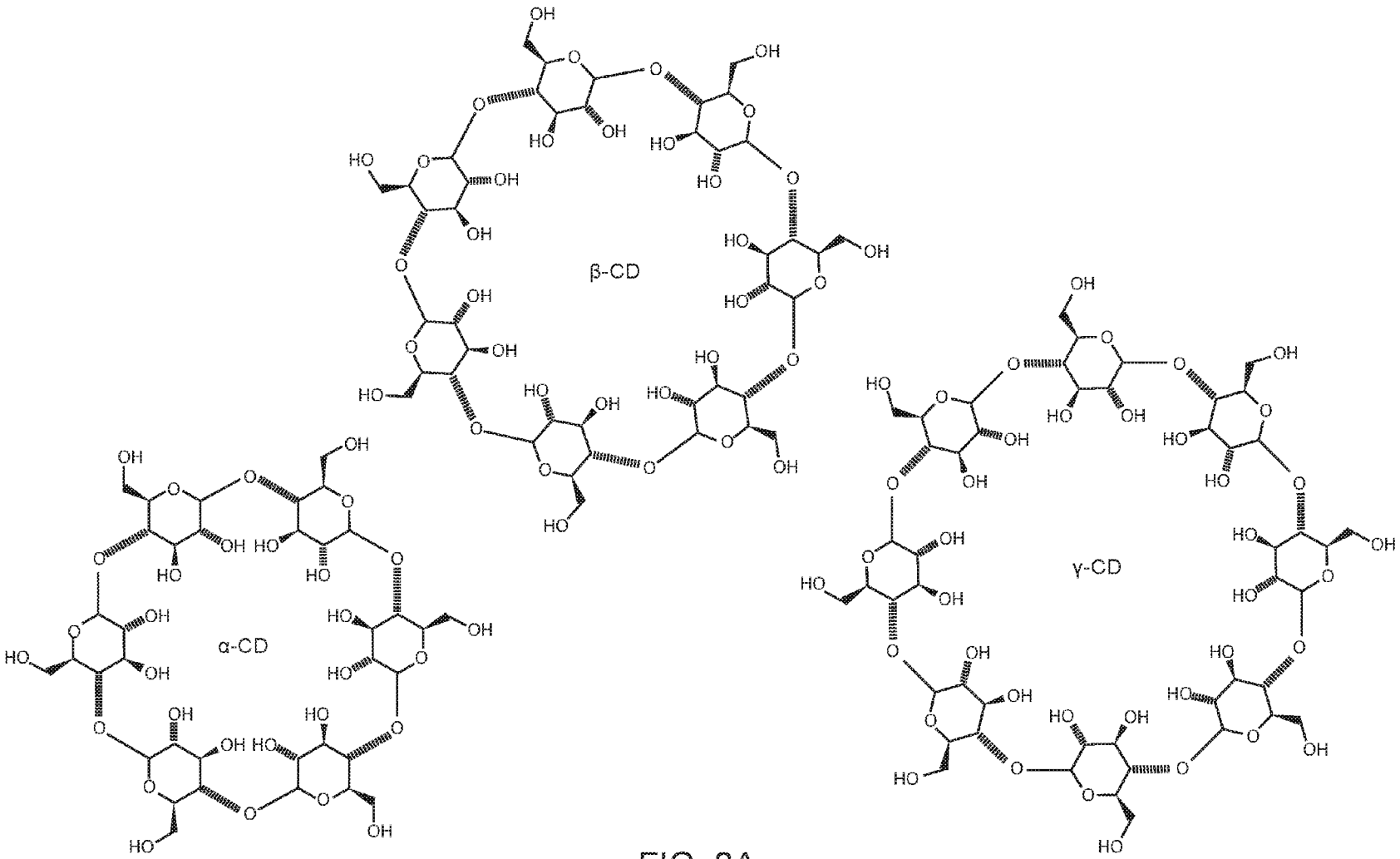
FIG. 2A shows the molecular structure of one type of cyclodextrin (cyclic saccharides) according to the present invention.

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

The present invention is a liquid electrically initiated and controlled composition comprising an oxidizer and at least one fuel additive. The electrically controlled liquid composition (whether propellants, explosives, gas generators, or pyrotechnics) can be ignited and controlled by applying electrical voltage. The liquid composition further comprises a variety of additives that enhance the chemical or ballistic properties, or a combination thereof.

FIG. 1 shows an example of a liquid composition that has proven effective for oil and gas well fracking, when demonstrated in small-scale glass capillaries simulating 70 micron or smaller subsurface passages. The liquid composition provides a baseline formulation for related applications in chemical propulsion, pyrotechnics, and commercial explosives, when purposely formulated for specific applications in these areas. In the preferred embodiments, the oxidizer/oxidant used is hydroxylammonium nitrate ($NH_3OHNO_3$) or hydroxylamine nitrate (HAN). The liquid electrically initiated and controlled composition typically comprises hydroxylammonium nitrate ($NH_3OHNO_3$) at 65-79 percent by weight, soluble fuel additive(s) at 15-30 percent by weight, and various optional additives to enhance the chemical and ballistic properties.

Stabilizers may be added to the liquid composition for enhancing thermal stability, and sequestrants may be included to remove transition metal contaminants such as iron, copper and nickel. Buffers and heavy metal sequestering or complexing agents may be added in combination to achieve the highest degree of thermal stability in the liquid composition. Proper selection of these additives will increase the exothermic peak temperature by 100 deg. F. or more. Preferred buffers are ammonium or organic amine dihydrogen phosphates such as $NH_4H_2PO_4$, or diammonium or di-organic amine monohydrogen phosphates such as $(NH_4)_2HPO_4$ although other suitable buffers may be utilized as well. Preferred sequestering agents are 2,2'-Bipyridyl and its ring-substituted derivatives. Further additives may be included in the liquid composition in accordance with known technology.

The liquid composition comprises a stabilizer and sequestrant added at 0.1-1.0 percent by weight. In the preferred embodiment, the stabilizer and sequestrant is 2,2'-Bipyridyl ($C_{10}H_8N_2$). As a stabilizer, 2,2'-Bipyridyl acts as a base that can neutralize any acid generated due to HAN decomposition. As a sequestrant, 2,2'-Bipyridyl is an effective chelating agent forming complexes with many transition metals. The liquid composition further comprises a buffer added at 0.1-1.0 percent by weight. In the preferred embodiment, the buffer is ammonium dihydrogen Phosphate or monoammonium phosphate ($NH_4H_2PO_4$), which acts as a buffering compound for any nitric acid generated due to HAN decomposition. Ammonium dihydrogen phosphate and 2,2'-bipyridyl stabilizes the HAN liquid oxidizer. The liquid composition further comprises water as a process aid. Water acts as a processing aid and desensitizer and is added to the liquid composition at 1-3 percent by weight.

The liquid composition comprises soluble fuel additive(s) at 15-30 percent by weight. The fuel additive is selected from the group consisting of cyclic saccharides, including α-cyclodextrin, β-cyclodextrin and γ-cyclodextrin; complex sugars/polysaccharides including xylose, sorbitol, amylose, amylopectin, and plant based starches; and polyhydroxyl compounds including hydroxyethyl cellulose, hydroxypropyl cellulose, and methyl hydroxyethyl cellulose soluble in the liquid HAN oxidizer matrix.

Polyhydroxyl compounds such as cellulose compounds with hydroxyethyl-, hydroxypropyl-, methyl hydroxyethyl- and related substitutions, and cellulosic esters, such as methyl hydroxyethyl cellulose (MHEC) may be added to the liquid composition. The polyhydroxyl compounds act as viscosity modifiers that provide selective adjustment of the viscosity and flow characteristics (that is, rheology) of the composition. Modification of viscosity allows beneficial and superior application of the liquid composition in specific locales such as subsurface as electrically initiated fracking fluids, or in devices having flow-through electrode features. In the preferred embodiment, a benefit is seen in the adjustment of viscosity and flow characteristics, formulation rheology, hydraulic nature, and capability to hold or suspend particulate additives without separation or classification, when selected.

Figure 2B:
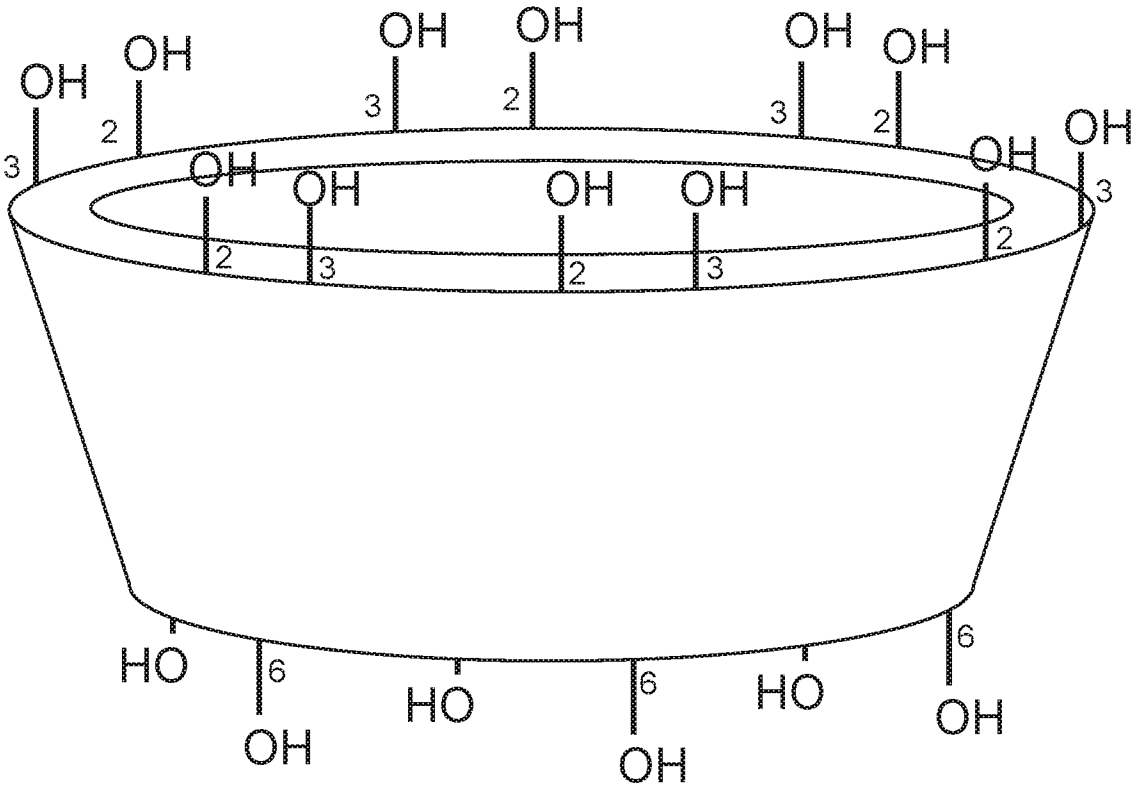
FIG. 2B shows the molecular structure of one types of cyclodextrin (cyclic saccharides) according to the present invention.
Figure 2C:
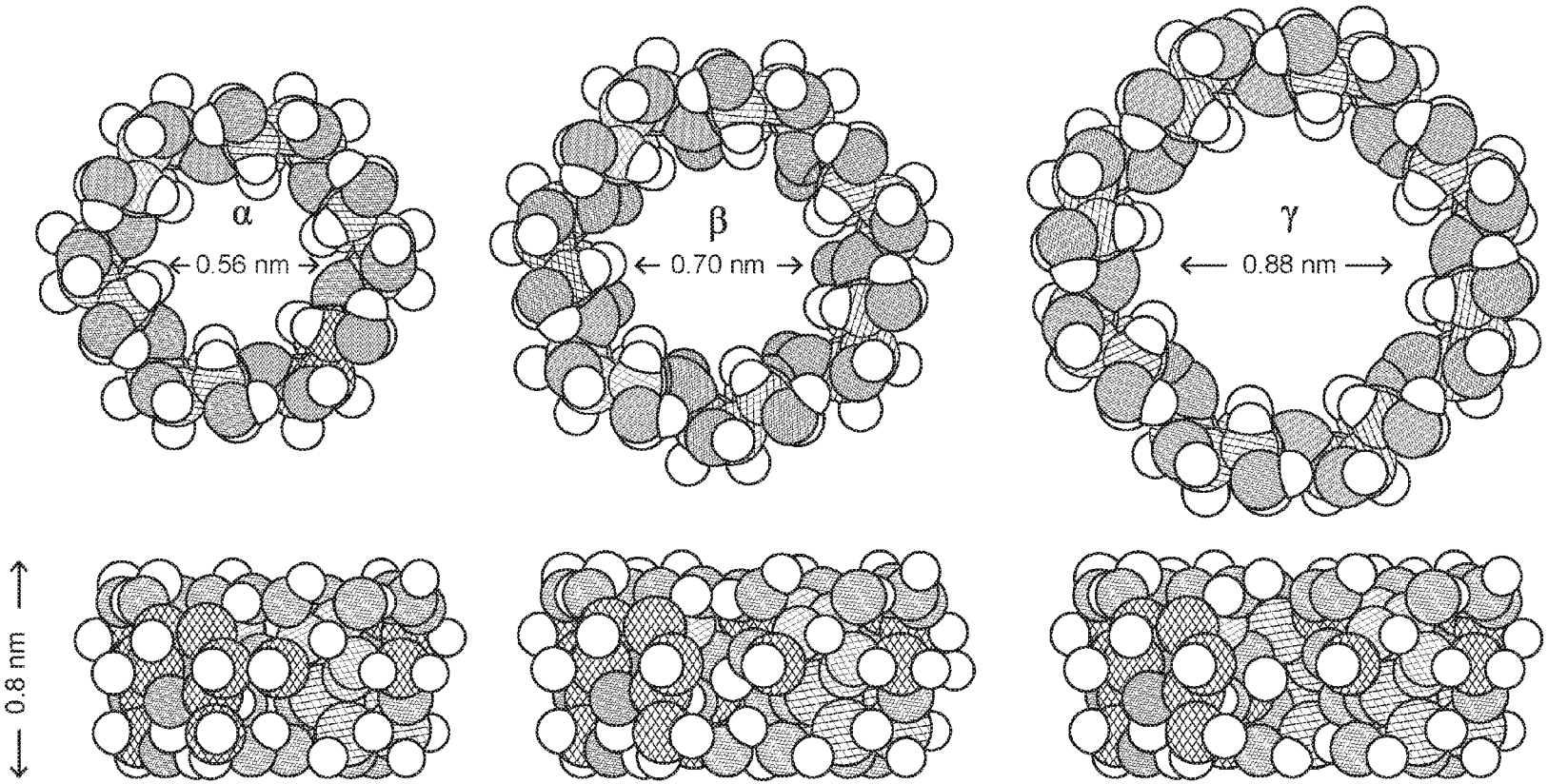
FIG. 2C shows the molecular structure of one types of cyclodextrin (cyclic saccharides) according to the present invention.

Cyclic saccharides (cyclodextrins) may be added to the liquid composition. The molecular structures of several such cyclodextrins are shown in FIGS. 2A-2C. These materials are formulated in a wide percentage range allowing tailorability of the performance of liquid compositions, based on their high solubility from 0 to greater than 25 percent by weight in the liquid oxidizer, a key aspect of the utility in electrical liquid compositions. These compounds are highly soluble in the liquid HAN oxidizer matrix and provide increased stability and storage life. Additionally, cyclodextrins are able to sequester undesirable contaminants such as transition metal ions that may destabilize the liquid composition, resulting in undesirable off-gassing or premature decomposition, and increase hazard characteristics such as sensitivity to impact or friction. The addition of these cyclic saccharides (cyclodextrins) beneficially increases the onset temperature of exothermic propellant reaction. The cyclic saccharides may be α-cyclodextrin, β-cyclodextrin or γ-cyclodextrin, with or without substituents, which add to mechanical or ballistic performance. FIG. 2D shows a table of properties of the three main types of cyclodextrins.

Referring to FIGS. 2A-2C, cyclodextrins consist of (α-1, 4)-linked α-D-glucopyranose units and contain a somewhat lipophilic central cavity and a hydrophilic outer surface. α-, β- and γ-cyclodextrin consist of six, seven, and eight glucopyranose units, respectively. Due to the chair conformation of the glucopyranose units, the cyclodextrins are shaped like a truncated cone with secondary hydroxyl groups extending from the wider edge and the primary hydroxyl groups from the narrow edge. The central cavity is lined by the skeletal carbons and ethereal oxygens of the glucose residues, which gives it a lipophilic character. All three cyclodextrins have similar structures (that is, bond lengths and orientations) apart from the structural necessities of accommodating a different number of glucose residues. The cavities have different diameters dependent on the number of glucose units. The side rim depth is the same (at about 0.8 nm) for all three cyclodextrins. Cyclodextrin rings are amphipathic with the wider rim displaying the 2- and 3-OH groups and the narrower rim displaying 6-OH group on its flexible arm. These polar groups are on the outside of the molecular cavity whereas the inner surface is non-polar. Thus, the otherwise polar cyclodextrin molecules have the ability to form inclusion complexes with non-polar molecules due to the unique nature imparted by their structure.

As shown in FIGS. 2A-2C, the 3D structure of the cyclic saccharides (cyclodextrins) provides the ability to sequester or retain transition metal contaminants, and provides the stated benefits of increased ballistic, rheological, and conductive properties by utilizing their cavity structure to form inclusion compounds, as well as greater stability for storage or use at elevated temperatures. The 3D structure of the cyclic saccharides (cyclodextrins) also provides a pathway to introduce non-polar compounds to the generally polar liquid composition. Such non-polar compounds may comprise additive benefits which impart desired burning rates, ignitability improvement, flame spreading, gas output, and other benefits, which otherwise would not be available due to immiscible behavior. Preferably the cyclic saccharides (cyclodextrins) are added up to approximately 30 percent by weight to the liquid composition.

Complex sugars or polysaccharides, such as but not limited to xylose, sorbitol, amylose, amylopectin, and including before mentioned cyclodextrins, and plant based starches may be added to the liquid composition. When added at between 5 percent to approximately 25 percent weight, these compounds impart burning rates from 1 to 10 ips (inches per second) at 1000 psi while remaining highly soluble in the HAN—ionic liquid oxidizer blends. At present, such burning rates are unachievable without the addition of selected destabilizing metallic or metalloid additives.

The liquid composition comprises a processing aid surfactant added at 0.1-0.5 percent by weight. In the preferred embodiment, the surfactant is n-octanol.

The liquid composition further comprises a combustion enhancer sequestrant and stabilizer added at 1-3 percent by weight. The combustion enhancer may be a polynitrogen compound selected from the group consisting of, but not limited to, 5-aminotetrazole (5-ATZ) and 1,2,4-triazole. Polynitrogen compounds, such as but not limited to 1,2,4-triazole and 5-aminotetrazole or substituted triazoles, and tetrazoles may be added to the liquid composition to increase the stability and onset temperatures. Preferably the polynitrogen compounds are added at 0.01-5 percent by weight, but may be added in greater or lesser quantities. The addition of 1,2,4-triazole has been observed to shift onset temperature from 172° C. to 213° C. A plot of the onset temperature shift due to the addition of 1,2,4-triazole is shown in FIG. 3. 5-aminotetrazole is amphoteric in nature and acts as a buffer to absorb either acid or base to maintain the proper acidity of the oxidizer, and its ability to readily form insoluble complexes with heavy metals effectively eliminates their destabilizing effects.

Figure 3:
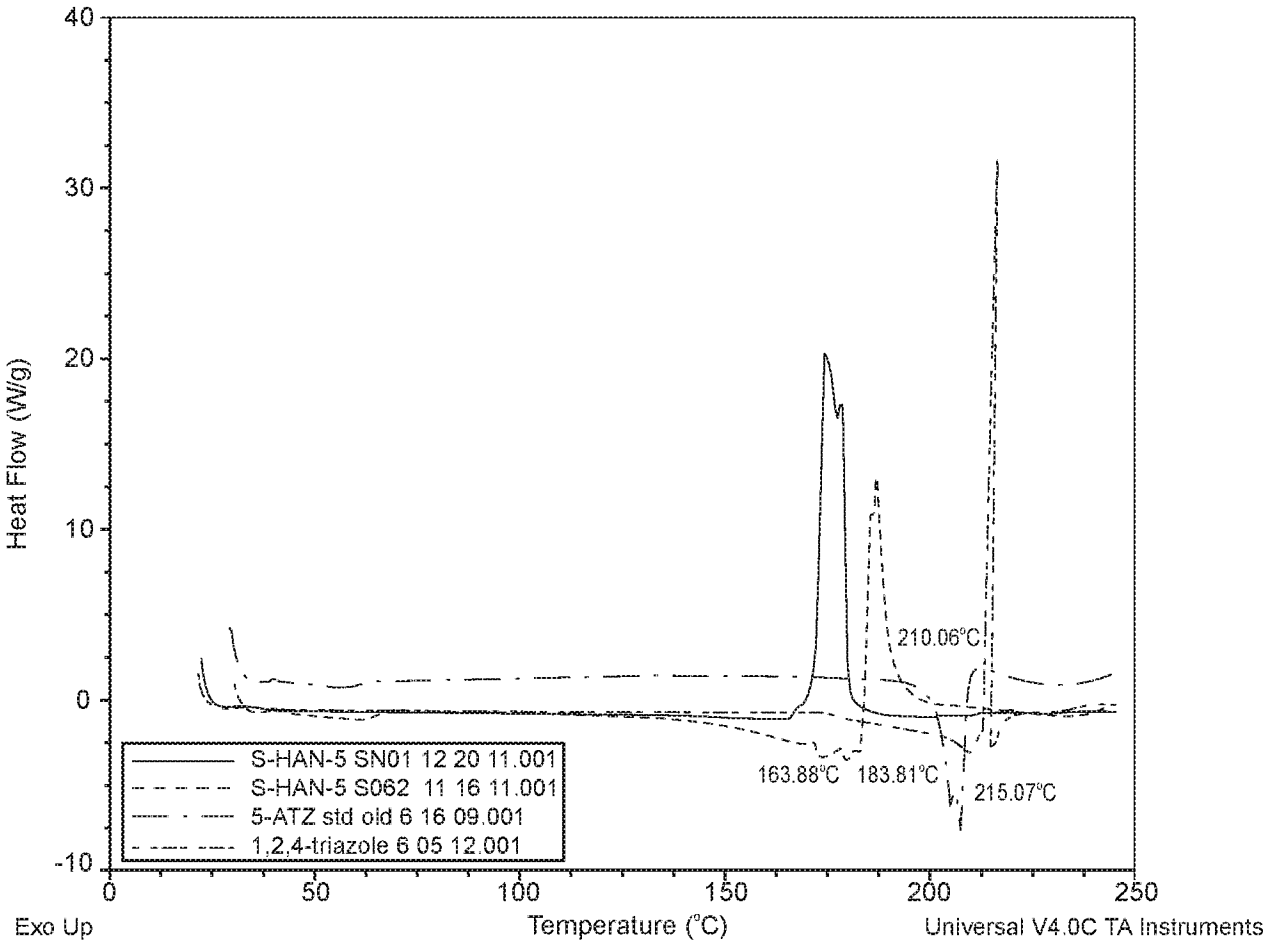
FIG. 3 is a differential scanning calorimetry (DSC) plot showing Heat Flow in W/g on the Y-axis and Temperature in ° C. on the X-Axis.

FIG. 3 shows a differential scanning calorimetry (DSC) plot showing Heat Flow in W/g on the Y-axis and Temperature in ° C. on the X-Axis. The differential scanning calorimetry (DSC) plot representing heat flow rate vs. temperature produced at an exothermic peak temperature, whose onset and peak temperatures were noted as indications of the thermal stability of the formulations containing different combustion enhancers. The plot shows preferred increased downpeak location at higher temperatures (exothermic onset temperatures) of nitrogen substituted heterocyclic compounds (polynitrogen compounds) such as triazoles and tetrazoles in the liquid composition. Progression, low temperature to preferred higher temperatures, is S-HAN (stabilized-hydroxylammonium nitrate) liquid oxidizer at 163.88° C., improved S-HAN liquid oxidizer at 183.81° C., liquid oxidizer with 5-aminotetrazole stabilizer at 210.06° C., and liquid oxidizer with 1,2,4-triazole stabilizer at 215.07° C. Higher onset temperatures indicate improved stability of liquid oxidizer solutions.

The liquid composition comprises a co-oxidizer added at 2-7 percent by weight. The co-oxidizer is selected from the group consisting of, but not limited to, ammonium nitrate, methyl ammonium nitrate, hydroxyethylammonium formate, and other oxygen-balance favorable soluble ingredients. These compounds have been found to lower the crystallization temperature of HAN. Additional liquid ionic co-oxidizers may be added to the liquid composition to stabilize the liquid composition and further depress the freezing point. The liquid ionic co-oxidizer may comprise, but not be limited to, hydroxyethylammonium formate at 0.01-20 percent weight; the addition of which lowers the freezing point of the liquid composition to less than −70° C. Additional soluble salts may be added to the liquid composition to depress freezing points and add additional benefits such as improvements to ignition response, gas output, and fast combustion propagation in passageways less than 100 micron in any dimension, such as monomethylammonium nitrate, which is found to be soluble up to 50 percent by weight or higher in electrically ignited liquid compositions.

Nano-engineered fuel additives (particulate modifiers) may be added to the liquid composition to achieve very high burning rates. Such compounds may comprise Al, B, Si, or Ti. With these fuel additives, the liquid composition combusts at greater than 1 ips to 10 ips or faster from 500 to 1500 psi. Generally, the additives have an approximate diameter of 100 nanometers or less. Nano-engineered refractory materials, such as $SiO_2$, $TiO_2$, zeolites, and similar high melting point compounds may also be included to impart heterogeneous catalytic behavior to enhance combustion or tailor combustion products in the liquid composition. Levels of these nano-engineered fuel additives are effective at low concentrations of less than 5 percent, preferably.

In the preferred embodiment of the present invention, the liquid electrically initiated and controlled composition typically comprises hydroxylammonium nitrate (HAN) at 65-79 percent by weight, soluble fuel additive(s) at 15-30 percent by weight, and optional additives such as 2,2'-Bipyridyl (stabilizer and sequestrant) at 0.1-1.0 percent by weight, ammonium dihydrogen phosphate (buffer) at 0.1-1.0 percent by weight, water (desensitizer, artifact of production) at 1-3 percent by weight, n-octanol (surfactant) at 0.1-0.5 percent by weight, 5-aminotetrazole (combustion enhancer) at 1-3 percent by weight, 1,2,4-triazole (or substituted triazoles and tetrazoles, as combustion enhancer and stabilizers) at 1-3 percent by weight, and a co-oxidizer (such as ammonium nitrate or other oxygen-balance favorable soluble ingredients) at 2-7 percent by weight. Further additives may be included in the composition in accordance with known technology.

The liquid composition has several applications such as stimulating subsurface oil or gas well production, a replacement of conventional explosives for mining purposes, in chemical propulsion and pyrotechnics. The liquid composition improves upon previously disclosed electrically ignited or controlled solid compositions through the selective formulation modifications, resulting in the propellants taking on a liquid form. The liquid phase of matter allows for flow via pipes or tubes from tanks, reservoirs, or other containers, and through metering valves, followed by ignition or combustion modulation when stimulated by electrified contacts (electrodes). Electrodes may be powered when the liquid composition is static and in contact, or in flow-through motion while in contact with metering orifices that also function as electrode surfaces. The electrodes may be, without limitation, foams, rods, wires, fibers, conductively coated particles, mesh structures, or woven structures. In one embodiment, while the electrode is in contact with the gas generator composition an electrical voltage is applied to said composition via the electrode.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

We claim:

1. A method of controlling gas generation, the method comprising the steps of:

a. providing an electrically controlled gas generator composition comprising:
   i. oxidizer at 65-79 percent by weight;
   ii. fuel additive at 15-30 percent by weight; and
   iii. a stabilizer and sequestrant at 0.1-1.0 percent by weight;
   iv. a buffer at 0.1-1.0 percent by weight; and
   v. a co-oxidizer;
b. providing an electrode in contact with said gas generator composition; and
c. applying an electrical voltage to said gas generator composition via said electrode.

2. The method according to claim 1 wherein the oxidizer is hydroxylammonium nitrate (HAN).

3. The method according to claim 1 wherein the fuel additive is selected from the group consisting of cyclic saccharides, complex sugars/polysaccharides and polyhydroxyl compounds soluble in liquid HAN oxidizer matrix.

4. The method according to claim 1 wherein the stabilizer and sequestrant is 2,2'-Bipyridyl.

5. The method according to claim 1 wherein the buffer is ammonium dihydrogen phosphate.

6. The method according to claim 1 wherein said gas generator composition further comprises a desensitizer at 1-3 percent by weight.

7. The method according to claim 6 wherein the desensitizer is water.

8. The method according to claim 1 wherein said gas generator composition further comprises a surfactant at 0.1-0.5 percent by weight.

9. The method according to claim 8 wherein the surfactant is n-octanol.

10. The method according to claim 1 wherein said gas generator composition further comprises a combustion enhancer at 1-3 percent by weight.

11. The method according to claim 10 wherein the combustion enhancer is a polynitrogen compound selected from the group consisting of 5-aminotetrazole and 1,2,4-triazole.

12. The method according to claim 1 wherein said gas generator composition further comprises a co-oxidizer at 2-7 percent by weight.

13. The method according to claim 12 wherein the co-oxidizer is selected from the group consisting of ammonium nitrate, methyl ammonium nitrate and hydroxyethylammonium formate.

* * * * *